US011447323B2

(12) United States Patent
Kataoka et al.

(10) Patent No.: US 11,447,323 B2
(45) Date of Patent: Sep. 20, 2022

(54) PACKAGE AND BUFFER TOOL

(71) Applicant: TDK CORPORATION, Tokyo (JP)

(72) Inventors: Naruki Kataoka, Tokyo (JP); Tatsuya Kojima, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/036,545

(22) Filed: Sep. 29, 2020

(65) Prior Publication Data

US 2021/0101732 A1 Apr. 8, 2021

(30) Foreign Application Priority Data

Oct. 8, 2019 (JP) ..... JP2019-185189

(51) Int. Cl.
*B65D 81/02* (2006.01)
*B65D 81/05* (2006.01)
*B65D 85/672* (2006.01)

(52) U.S. Cl.
CPC ..... *B65D 81/05* (2013.01); *B65D 85/672* (2013.01)

(58) Field of Classification Search
CPC ..... B65D 81/05; B65D 85/672
USPC ..... 206/521, 586, 587, 591–594, 424, 499, 206/585; 229/101
See application file for complete search history.

(56) References Cited

U.S. PATENT DOCUMENTS 1,125,535 A * 1/1915 Hoffman ..... B65D 5/0005 229/101
3,221,973 A * 12/1965 Kalbrener ..... B65D 5/5033 206/600
3,666,166 A * 5/1972 Freakes ..... B65D 75/28 206/424
3,982,682 A * 9/1976 Fremion ..... B65D 5/5033 206/586
3,994,399 A * 11/1976 Numata ..... B65D 5/5038 206/594
4,300,679 A * 11/1981 Benzschawel ..... B65D 5/0245 206/424
4,322,028 A * 3/1982 Kawahara ..... B65D 75/14 229/92.7
4,589,552 A * 5/1986 Chevalier ..... B65D 5/0245 206/424
5,197,260 A * 3/1993 Chevalier ..... B65B 11/004 53/461
5,390,820 A * 2/1995 Wright ..... B65D 83/0811 221/56

(Continued)

FOREIGN PATENT DOCUMENTS

JP S54-170983 U 12/1979
JP H06-80178 A 3/1994

*Primary Examiner* — Luan K Bui
(74) *Attorney, Agent, or Firm* — Oliff PLC

(57) ABSTRACT

A package includes a storage portion that stores an object to be stored, and a buffer portion that reduces a gap generated between the object to be stored and the storage portion. The storage portion includes a bottom and a lid facing the bottom, and the buffer portion includes a base facing the object to be stored in a stacking direction from the bottom toward the lid, a first fold, and a space adjusting portion connected to the base at the first fold. The space adjusting portion includes an adjusting region extending in the stacking direction, a plurality of second folds distributed in a first direction intersecting the first fold, and a contact region connected to the adjusting region at one of the plurality of second folds.

16 Claims, 5 Drawing Sheets

(56) References Cited

U.S. PATENT DOCUMENTS

| | | | | |
|---|---|---|---|---|
| 9,427,056 | B2 * | 8/2016 | Nietvelt | B65B 49/14 |
| 2004/0206657 | A1 * | 10/2004 | Yokawa | B65D 5/5035 206/523 |
| 2006/0180498 | A1 * | 8/2006 | Muyskens | B65D 19/0002 206/592 |
| 2010/0187149 | A1 * | 7/2010 | Tsukii | B65D 5/5035 206/521 |
| 2017/0291758 | A1 * | 10/2017 | Muzzall | B65D 85/505 |

* cited by examiner

PACKAGE AND BUFFER TOOL

BACKGROUND OF THE INVENTION

1. Field of the Invention

One aspect of the present invention relates to a package. Another aspect of the present invention relates to a buffer tool.

2. Description of Related Art

A package includes a container storing an object. The object includes a component containing electronic components, for example. The size of the object to be stored may be smaller than the size of the container. In this case, a gap is generated between the object to be stored and the container. When the container that stores the object to be stored is transported in a state where the gap has been generated, for example, a vibration during transport may cause the component to collide with an inner wall of the container or other components, and give damage to the electronic component contained in the component.

There are known a package and a buffer material for packaging that reduce a gap generated between a stored component and a container to prevent damage to the stored component in the container. The known package stores a plurality of components stacked in order from the bottom of the container and then stacks a buffer portion on the stacked components so as to fill the gap generated above the components. The buffer portion reduces collision between the stored components and an inner wall of the container (for example, see Japanese Unexamined Patent Publication No. H06-80178). The known buffer material for packaging is made of a strip-shaped paper or a synthetic resin board, and has a shape capable of buffering and holding the component stored in the container (for example, see Japanese Unexamined Utility Model Publication No. S54-170983).

SUMMARY OF THE INVENTION

When an object is stored in a container, the size of a gap generated between the stored object and the container differs depending on the size of the object to be stored. It is required to superimpose a plurality of buffer portions on top of each other due to the size of the generated gap. Alternatively, it is required to prepare a plurality of buffer portions having different sizes in advance, and select one buffer portion adapted to the size of the gap from the plurality of buffer portions. A package requires further improvement to sufficiently reduce the gap generated between the object to be stored and the container.

An object of one aspect of the present invention is to provide a package in which a buffer portion is adjustable to sufficiently reduce a gap generated between an object to be stored and a storage portion. An object of another aspect of the present invention is to provide a buffer tool that is adjustable to sufficiently reduce a gap generated between an object to be stored and a storage portion.

A package according to one aspect includes a storage portion storing an object to be stored, and a buffer portion reducing a gap generated between the object to be stored and the storage portion. The storage portion includes a bottom and a lid facing the bottom, and the buffer portion includes a base facing the object to be stored in a stacking direction from the bottom toward the lid, a first fold, and a space adjusting portion connected to the base at the first fold. The first fold is provided to bend the buffer portion between the base and the space adjusting portion. The space adjusting portion includes an adjusting region extending in the stacking direction, a plurality of second folds distributed in a first direction intersecting the first fold, and a contact region connected to the adjusting region at one of the plurality of second folds. The plurality of second folds are provided to bend the space adjusting portion at each of the plurality of second folds, one of the plurality of second folds defining a boundary between the contact region and the adjusting region. The base, the adjusting region, and the contact region are aligned in order.

In the one aspect, the buffer portion includes the base and the space adjusting portion. In a configuration where the space adjusting portion includes the plurality of second folds, one second fold that defines the boundary between the contact region and the adjusting region is selected from the plurality of second folds. When the object to be stored and the buffer portion are stored in the storage portion in the stacking direction, the width of the adjusting region of the buffer portion is adjustable to be changed due to the size of the gap generated between the object to be stored and the storage portion in the stacking direction. The adjusting region extends in the stacking direction to reduce the gap generated between the object to be stored and the storage portion in the stacking direction. The contact region comes into contact with the object to be stored to reduce a movement of the object to be stored in the storage portion, with the adjusting region. There is provided the package in which the buffer portion is adjustable to sufficiently reduce the gap generated between the object to be stored and the storage portion.

In the one aspect, when the object to be stored and the buffer portion are stacked on the bottom to be stored in the storage portion, the object to be stored may have a first height in the stacking direction, the buffer portion may be bent between the base and the space adjusting portion at the first fold, and the one of the plurality of second folds may define the boundary between the contact region and the adjusting region, so that the adjusting region has a second height in the stacking direction. A sum of the first height and the second height may be approximately equal to a height from the bottom to the lid in the stacking direction. In a configuration where the sum of the first height and the second height is approximately equal to the height from the bottom to the lid in the stacking direction, the gap generated between the object to be stored and the storage portion is more sufficiently reduced.

In the one aspect, the base may have a lower surface facing the object to be stored, the buffer portion may include a first surface including the lower surface, and the first fold may be provided on the first surface. In a configuration where the first fold is provided on the first surface, the buffer portion is easily bent inward of the first surface between the base and the space adjusting portion at the first fold.

In the one aspect, the plurality of second folds may be provided on the first surface. In a configuration where the plurality of second folds is provided on the first surface, the space adjusting portion is easily bent inward of the first surface between the contact region and the adjusting region at one of the second folds.

In the one aspect, the base may further include an upper surface opposite to the lower surface and a through-hole penetrating through the base from the upper surface to the lower surface. In a configuration where the base facing the object to be stored includes the through-hole, the object to be stored can be seen through the through-hole when the object to be stored and the buffer portion are stored in order in the storage portion.

In the one aspect, the contact region may include a contact surface coming into contact with the object to be stored. A movement of the object to be stored in the storage portion may occur during transport of the package. In a configuration where the contact region includes a contact surface, the buffer portion reduces the movement of the object to be stored.

In the one aspect, the space adjusting portion may include an end portion defining an end of the buffer portion in the first direction. The buffer portion may have a first interval between the first fold and the second fold adjacent to the first fold in the first direction. The buffer portion may include a second interval between the plurality of second folds adjacent to each other in the first direction. The buffer portion may include a third interval between the second fold being farthest away from the first fold among the plurality of second folds and the end portion of the space adjusting portion in the first direction. A minimum value of the third interval may be larger than a maximum value of either of the first interval and the second interval.

In a configuration where the minimum value of the third interval of the contact region is larger than the maximum value of either of the first interval and the second interval, the contact region having a wide width comes into contact with the object to be stored when the object to be stored and the buffer portion are stored in order in the storage portion. The buffer portion further reduces the movement of the object to be stored, which may occur during transport of the package.

In the one aspect, the buffer portion may be made of a corrugated cardboard, and at least one of the first fold and the second fold may intersect a grain direction of the corrugated cardboard. In a configuration where the buffer portion is made of a corrugated cardboard, the buffer portion is lightweight and is easy to produce. In a configuration where the first fold and the second folds intersect the grain direction of the corrugated cardboard, the buffer portion has high mechanical strength in a state where the buffer portion is bent at the fold.

In the one aspect, the object to be stored may be stored with gas in a packaging bag. In the configuration, the shape of the buffer portion is changed due to the size of the gap generated between the object to be stored and the storage portion in the stacking direction. In a case where a package containing the packaging bag in which gas exists is transported by airplane, the volume of the packaging bag increases due to a decrease in atmospheric pressure and the shape of the package bag changes. The buffer portion absorbs the change in the shape of the packaging bag. For example, even when the shape of the packaging bag is changed so as to expand from the end portion toward the center portion, the contact region continues to contact the upper surface of the object to be stored since the angle formed by the contact region and the adjusting region is decreased in the space adjusting portion. The buffer portion absorbs a change in shape of the object to be stored, or an increase in volume of the object to be stored.

In the one aspect, the object to be stored may be an aggregate of a plurality of components having heights approximately equal to each other, the plurality of second folds may be distributed at approximately equal intervals, and when the maximum number of the components storable in the storage portion is "n," the number of the plurality of second folds may be "n−1." In the configuration, the buffer portion having "n−1" second folds distributed at approximately equal intervals is prepared when the object to be stored is an aggregate of "n" components having heights approximately equal to each other. In the buffer portion, one second fold that defines the boundary between the contact region and the adjusting region is easily selected by counting the number of components.

In the one aspect, the component may be a reel, and a tape containing an electronic component is wound around the reel. In the configuration, the buffer portion sufficiently reduces the gap generated between the object to be stored and the storage portion.

A buffer tool according to another aspect includes a base, a first fold, and a space adjusting portion connected to the base at the first fold. The first fold is provided to bend the buffer tool between the base and the space adjusting portion. The space adjusting portion includes an adjusting region, a plurality of second folds distributed in a first direction intersecting the first fold, and a contact region connected to the adjusting region at one of the plurality of second folds. One of the plurality of second folds is provided to bent the space adjusting portion between the contact region and the adjusting region and to define a boundary between the contact region and the adjusting region. The base, the adjusting region, and the contact region are aligned in order. The buffer tool is arranged to reduce a gap generated between an object to be stored and a storage portion including a bottom and a lid facing the bottom and storing the object to be stored. The base is arranged to face the object to be stored in a stacking direction from the bottom toward the lid. The adjusting region is arranged to extend in the stacking direction.

In the another aspect, the buffer tool includes the base and the space adjusting portion, of which the space adjusting portion includes the plurality of second folds. One second fold that defines the boundary between the contact region and the adjusting region is selected from the plurality of second folds. When the object to be stored and the buffer tool are stored in the storage portion in the stacking direction, the width of the adjusting region of the buffer tool is changeable due to the size of the gap generated between the object to be stored and the storage portion in the stacking direction. The adjusting region extends in the stacking direction to reduce the gap generated between the object to be stored and the storage portion in the stacking direction. The contact region comes into contact with the object to be stored to reduce a movement of the object to be stored in the storage portion, with the adjusting region. There is provided the buffer tool that is adjustable to sufficiently reduce the gap generated between the object to be stored and the storage portion.

The present invention will become more fully understood from the detailed description given hereinafter and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating embodiments of the invention, are given by way of illustration only, since various changes and modifications within the spirit and scope of the invention will become apparent to those skilled in the art from this detailed description.

DETAILED DESCRIPTION OF EMBODIMENTS

Figure 1:
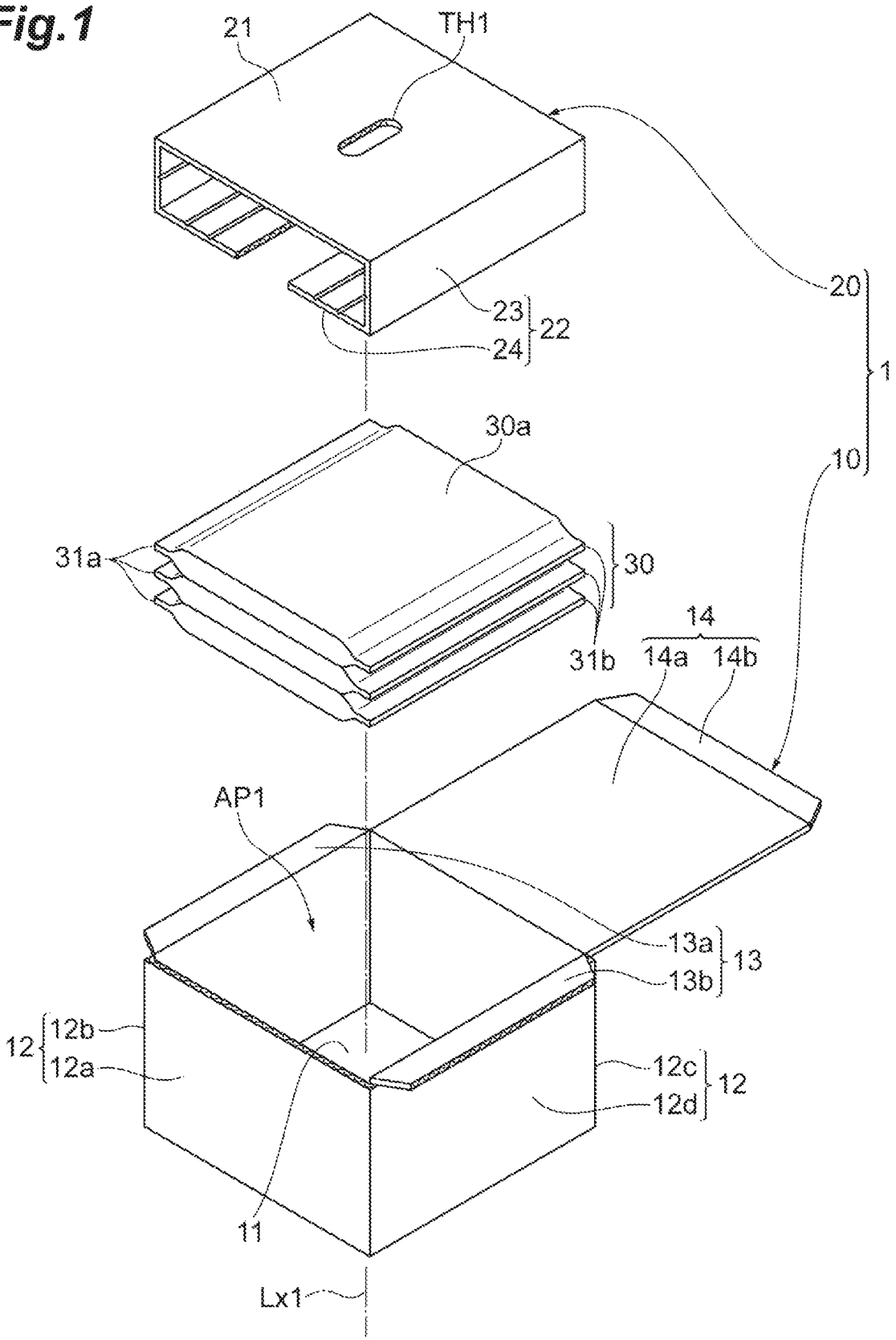
FIG. 1 is a perspective view schematically illustrating a package according to an embodiment.

Hereinafter, embodiments of the present invention will be described in detail with reference to the accompanying drawings. In the following description, the same elements or elements having the same functions are denoted with the same reference numerals and overlapped explanation is omitted.

Figures 2A, 2B, 2C:
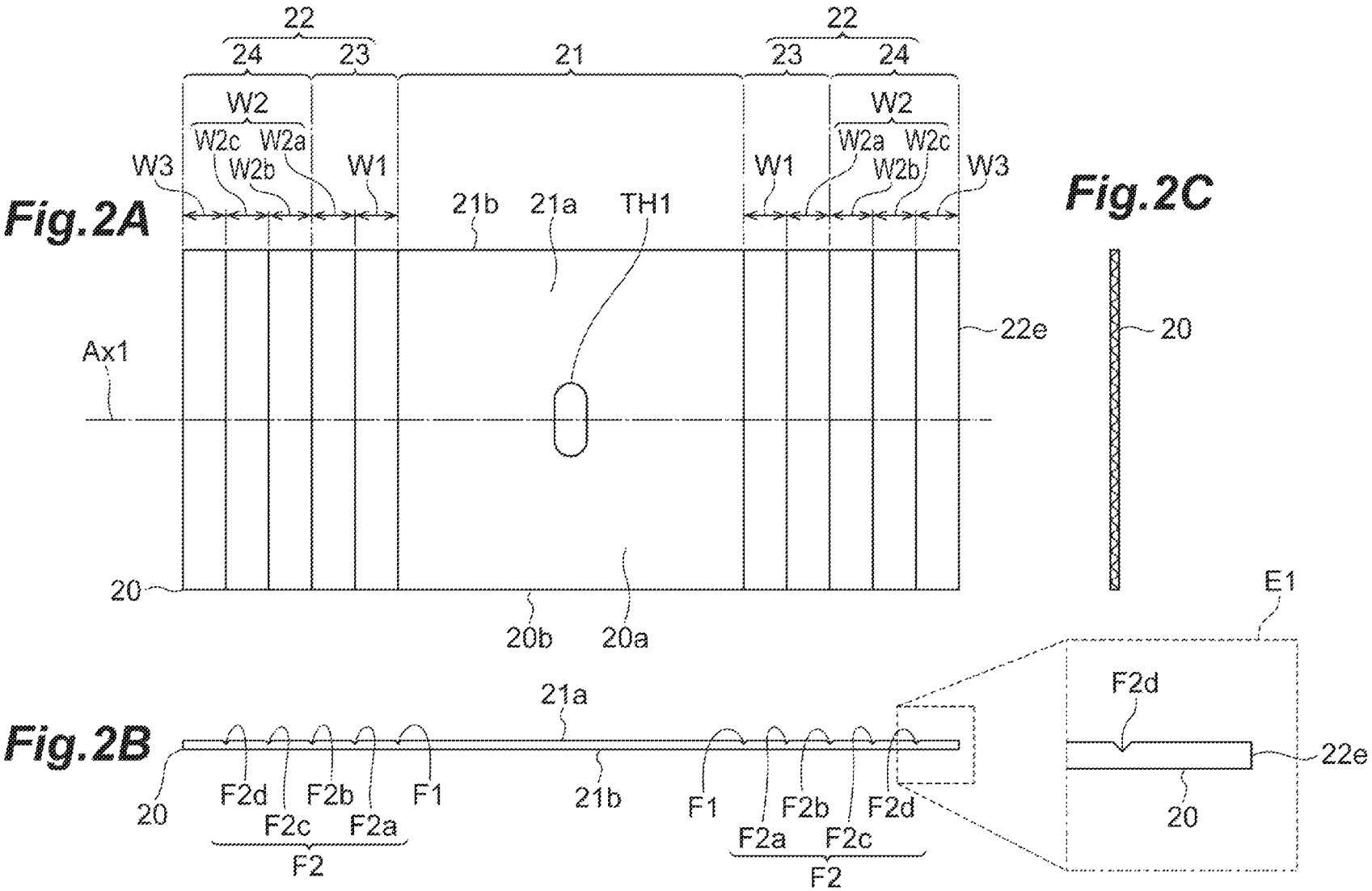
FIGS. 2A to 2C are views illustrating a buffer portion according to the present embodiment.
Figure 3A:
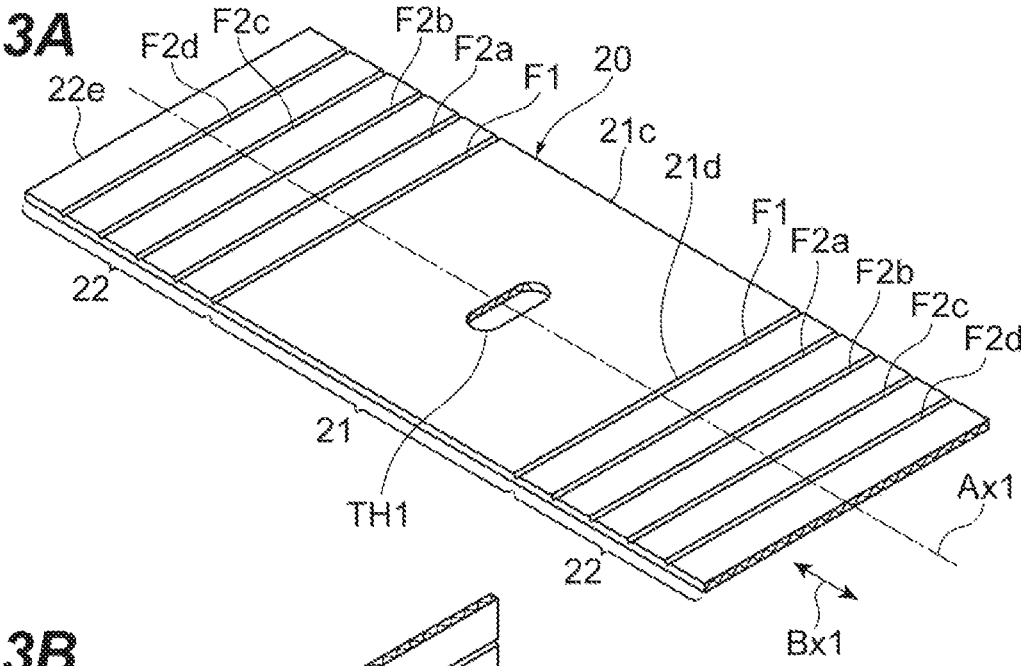
FIGS. 3A to 3C are views illustrating the buffer portion according to the present embodiment.
Figure 3B:
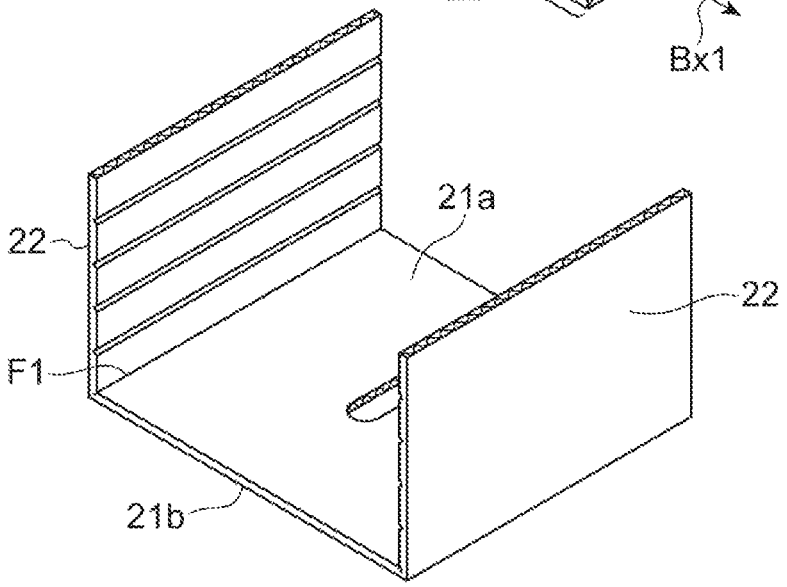
Figure 3C:
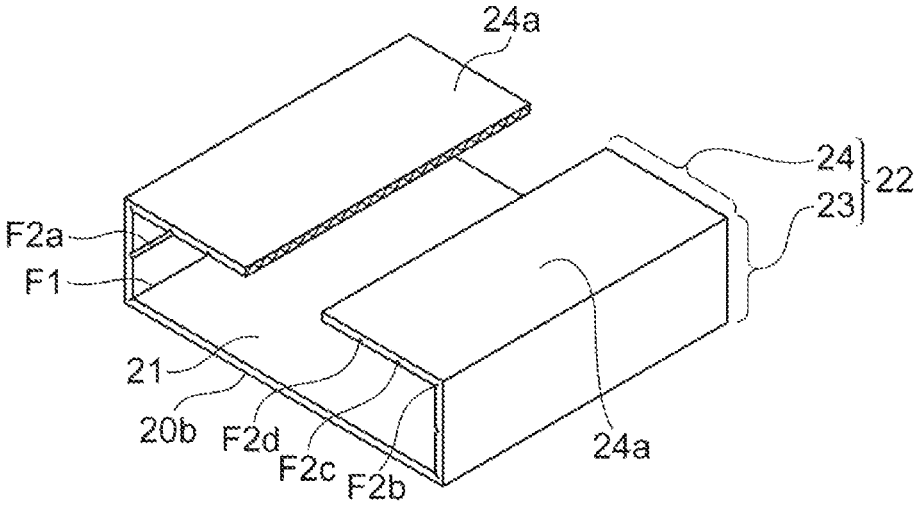
Figure 4A:
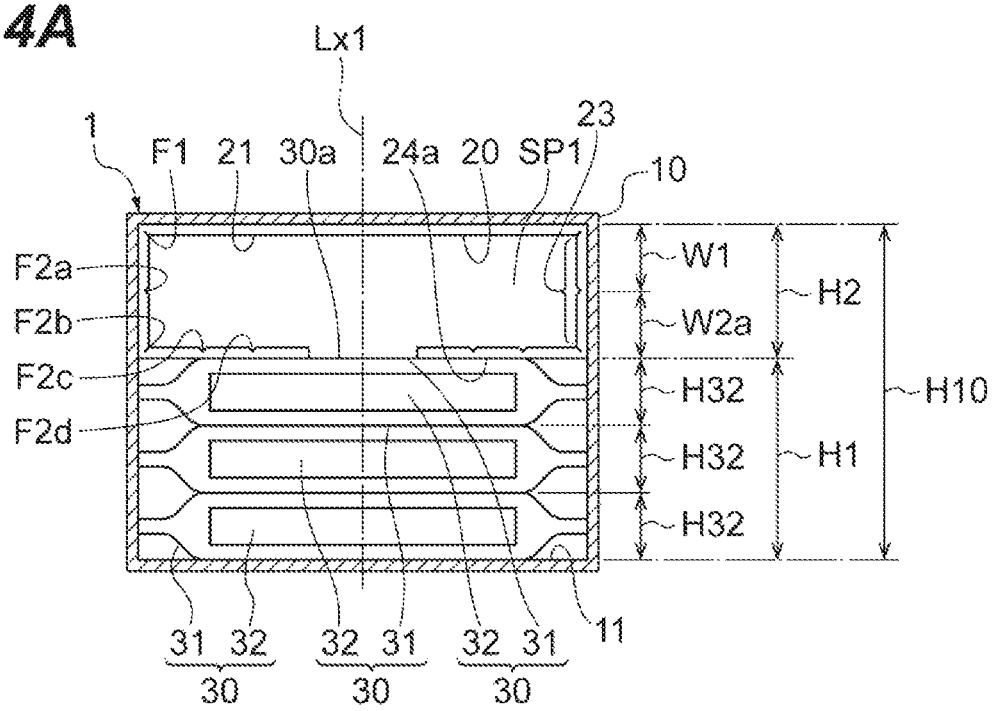
FIGS. 4A and 4B are views illustrating a cross-sectional configuration of the package according to the present embodiment.
Figure 4B:
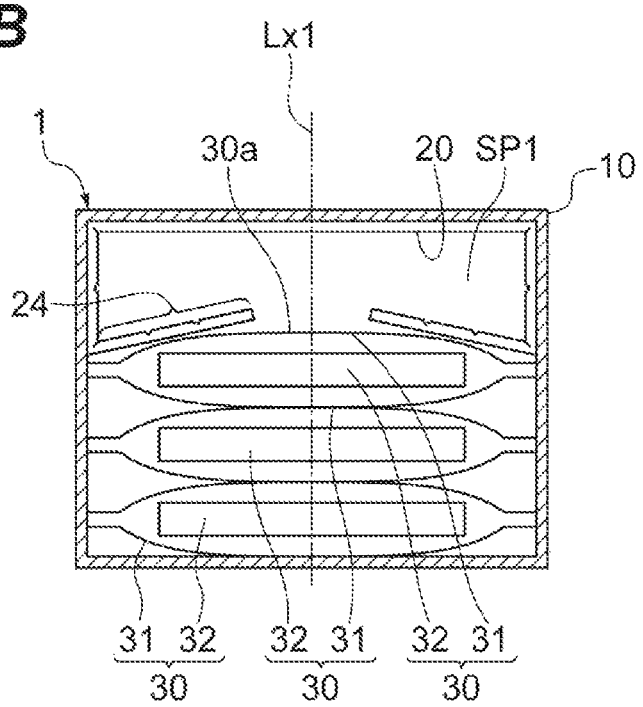

A configuration of a package 1 according to an embodiment will be described with reference to FIGS. 1 to 4B. FIG. 1 is a perspective views schematically illustrating a package according to the present embodiment. FIG. 2A is a plan view of a buffer portion according to the present embodiment. FIG. 2B is a front view of the buffer portion according to the present embodiment. FIG. 2C is a side view of the buffer portion according to the present embodiment. FIGS. 3A to 3C are views illustrating the buffer portion according to the present embodiment. FIGS. 3A to 3C illustrate the buffer portion having a shape adapted to a gap generated in a storage portion. FIG. 4A is a view illustrating a cross-sectional configuration of the package according to the present embodiment. FIG. 4B is a view illustrating a cross-sectional configuration of the package according to the present embodiment under reduced pressure.

As illustrated in FIG. 1, the package 1 includes a storage tool 10 and a buffer tool 20. The storage tool 10 is provided to store an object 30 to be stored. The buffer tool 20 reduces a gap SP1 generated between the object 30 and the storage tool 10. The gap SP1 is generated, for example, between an upper surface 30*a* of the object 30 and a lid 14 to be described later (refer to FIG. 4A). The storage tool 10 and the buffer tool 20 may form a storage portion and a buffer portion provided in the package 1, respectively.

The storage tool 10 includes a bottom 11, a side 12, a flap 13, and the lid 14. The storage tool 10 has, for example, a quadrilateral shape as viewed from a stacking direction Lx1 from the bottom 11 toward the lid 14. The bottom 11 is connected to the side 12. The side 12 includes, for example, four boards. In the present embodiment, the side 12 includes a first side board 12*a*, a second side board 12*b*, a third side board 12*c*, and a fourth side board 12*d*. The first side board 12*a* faces, for example, the third side board 12*c*. The second side board 12*b* faces, for example, the fourth side board 12*d*. A lower end of the first side board 12*a*, a lower end of the second side board 12*b*, a lower end of the third side board 12*c*, and a lower end of the fourth side board 12*d* are connected to the bottom 11. The first side board 12*a* is approximately orthogonal to, for example, the second side board 12*b* and the fourth side board 12*d*. The third side board 12*c* is approximately orthogonal to, for example, the second side board 12*b* and the fourth side board 12*d*.

The flap 13 includes, for example, a first flap 13*a* and a second flap 13*b*. The first flap 13*a* and the second flap 13*b* are connected to, for example, an upper end of the second side board 12*b* and an upper end of the fourth side board 12*d*, respectively.

The storage tool 10 includes an opening AP1 at an upper end of the side 12. The opening AP1 has, for example, a quadrilateral shape as viewed from the stacking direction Lx1. In the storage tool 10, the lid 14 includes, for example, a top board 14*a* and an insert 14*b*. The top board 14*a* is provided to face the bottom 11. The top board 14*a* is connected to, for example, an upper end of the third side board 12*c*. The insert 14*b* is connected to, for example, the top board 14*a* on an opposite side of the upper end of the third side board 12*c*. For example, when the top board 14*a* comes into contact with an upper end of the side 12 and the insert 14*b* comes into contact with an inner surface of the first side board 12*a*, the lid 14 reliably closes the opening AN. The storage tool 10 is made of, for example, a paper or plastic corrugated cardboard (material having a thickness structurally) or a paper or plastic board.

As illustrated in FIGS. 2A to 2C, the buffer tool 20 includes a base 21, a first fold F1, and a space adjusting portion 22. The buffer tool 20 includes, for example, a first surface 20*a* and a second surface 20*b* opposite to the first surface 20*a*. The first surface 20*a* includes a lower surface 21*a* of the base 21 to be described later. The base 21 faces the object 30. The space adjusting portion 22 is connected to the base 21 at the first fold F1. The first fold F1 defines a boundary between the base 21 and the space adjusting portion 22. The first fold F1 is provided to bend the buffer tool 20 between the base 21 and the space adjusting portion 22. The number of the space adjusting portions 22 is one or more. In the present embodiment, the space adjusting portions 22 is formed of, for example, two, and the space adjusting portions 22 are provided to interpose the base 21 therebetween in a first direction Ax1. The buffer tool 20 is bent between the base 21 and the space adjusting portion 22 at the first fold F1.

FIG. 3B illustrates a form of the buffer tool 20 illustrated in FIG. 3A in a state where the buffer tool 20 is bent between the base 21 and the space adjusting portion 22 at the first fold F1. In this state, the space adjusting portion 22 extends approximately perpendicular to the base 21.

As illustrated in FIG. 3A, the base 21 includes a first edge 21*c* and a second edge 21*d* intersecting the first edge 21*c*. In the present embodiment, the first edge 21*c* extends in, for example, the first direction Ax1. The second edge 21*d* is approximately orthogonal to the first edge 21*c*. Each of the first edge 21*c* and the second edge 21*d* has a length to the extent that the buffer tool 20 can pass through the opening AP1 of the storage tool 10 in the stacking direction Lx1. The length of the first edge 21*c* is, for example, approximately equal to the length of the second edge 21*d*. The two-dimensional shape of the base 21 is, for example, a quadrilateral. In the present embodiment, the two-dimensional shape of the base 21 is, for example, a substantially square.

In a state where the buffer tool 20 is stored with the object 30, in the storage tool 10, the base 21 faces the upper surface 30*a* of the object 30 (refer to FIG. 4A). The base 21 includes, for example, the lower surface 21*a* facing the upper surface 30*a* of the object 30, and an upper surface 21*b* opposite to the lower surface 21*a*. The base 21 further includes, for example, a through-hole TH1 penetrating therethrough from the upper surface 21*b* to the lower surface 21*a*. The number of the through-holes TH1 is one or more, and the through-holes are provided in, for example, a central region of the base 21. The through-holes TH1 may be provided in a peripheral region of the base 21. The lower surface 21*a* faces a space inside the storage tool 10. Therefore, the lower surface 21*a* constitutes the inner surface of the base 21. The upper surface 21*b* faces a space outside the storage tool 10. Therefore, the upper surface 21*b* constitutes the outer surface of the base 21.

The space adjusting portion 22 includes an end portion 22*e* opposite to the base 21. The space adjusting portion 22 includes an adjusting region 23, a plurality of second folds F2, and a contact region 24. The adjusting region 23 extends in the stacking direction Lx1 in the storage tool 10. The plurality of second folds F2 are distributed in the first direction Ax1 intersecting the first fold F1. The contact region 24 is connected to the adjusting region 23. One of the plurality of second folds F2 defines a boundary between the contact region 24 and the adjusting region 23. One of the plurality of second folds F2 is provided to bend the space adjusting portion 22 between the contact region 24 and the adjusting region 23. The base 21, the adjusting region 23, and the contact region 24 are aligned in order in the first direction Ax1.

FIG. 2A illustrates an example where the boundary between the contact region 24 and the adjusting region 23 is defined by a second fold F2*b* that is the second closest to the first fold F1 among the plurality of second folds F2. The first fold F1 is provided on, for example, the first surface 20*a*. The plurality of second folds F2 are also provided on, for example, the first surface 20*a*. The first fold F1 and the plurality of second folds F2 are provided on the first surface 20*a*.

FIG. 3C illustrates a configuration of the buffer tool 20 illustrated in FIG. 3B where the space adjusting portion 22 is further bent between the contact region 24 and the adjusting region 23 at one of the plurality of second folds F2. The contact region 24 extends approximately perpendicular to the adjusting region 23. In the example illustrated in FIG. 3C, the space adjusting portion 22 is bent between the contact region 24 and the adjusting region 23 at the second fold F2*b* of the plurality of second folds F2. In a state where the buffer tool 20 is stored with the object 30 in the storage tool 10, the adjusting region 23 extends in the stacking direction Lx1 in the storage tool 10 (refer to FIG. 4A). The contact region 24 extends, for example, approximately in parallel to the base 21.

The contact region 24 includes, for example, a contact surface 24*a* that comes into contact with the object 30. The contact surface 24*a* is positioned in the second surface 20*b* of the buffer tool 20. The contact surface 24*a* comes into contact with the upper surface 30*a* of the object 30 (refer to FIG. 4A).

As illustrated in FIG. 2A, the buffer tool 20 has a first interval W1 between the first fold F1 and the second fold F2 adjacent to the first fold F1 in the first direction Ax1. The buffer tool 20 has a second interval W2 between the plurality of second folds F2 adjacent to each other in the first direction Ax1.

The buffer tool 20 includes, for example, four folds as the plurality of second folds F2. In the present embodiment, the buffer tool 20 includes a second fold F2*a*, the second fold F2*b*, a second fold F2*c*, and a second fold F2*d* in order. For example, the second fold F2*a* is closest to the first fold F1 as compared with the other second folds. The second fold F2*d* is farthest from the first fold F1 as compared with the other second folds. The second fold F2*d* is provided in a closest position to the end portion 22*e* of the space adjusting portion 22.

In the present embodiment, three second intervals W2 are included in the four second folds F2. The three second intervals W2 consists of a second interval W2*a*, a second interval W2*b*, and a second interval W2*c*. The plurality of second folds are distributed at approximately equal intervals on the first surface 20*a*. For example, the second interval W2*a* is approximately equal to the second interval W2*b* and the second interval W2*c*. At least one of the second interval W2*a*, the second interval W2*b*, and the second interval W2*c* is approximately equal to the first interval W1. The first fold F1 and the folds of the plurality of second folds F2 may be distributed at approximately equal intervals. The second interval W2*a*, the second interval W2*b*, and the second interval W2*c* may differ from each other. All of the second interval W2*a*, the second interval W2*b*, and the second interval W2*c* may differ from the first interval W1.

The buffer tool 20 has a third interval W3 between the second fold F2*d* that is farthest away from the first fold F1 among the plurality of second folds F2 and the end portion 22*e* of the space adjusting portion 22 in the first direction Ax1. The minimum value of the third interval W3 is larger than, for example, the maximum value of either of the first interval W1 and the second interval W2.

FIG. 2B illustrates a region E1 in an enlarged manner. As illustrated in an enlarged view of the region E1, each fold has, for example, a V-shaped valley shape. The fold may have a semicircular shape. When each fold has these shapes, the buffer tool 20 is easily bent between the base 21 and the space adjusting portion 22 at the first fold F1, and the space adjusting portion 22 is easily bent between the contact region 24 and the adjusting region 23 at one of the plurality of second folds F2.

The buffer tool 20 is made of, for example, a paper or plastic corrugated cardboard (material having a thickness structurally) or a paper or plastic board. When the buffer tool 20 is made of a corrugated cardboard, the first fold F1 and the second fold F2 intersect a grain direction Bx1 of the corrugated cardboard. In the present embodiment, the grain direction Bx1 coincides with the first direction Ax1.

As described above, the buffer tool 20 is provided to reduce the gap SP1 generated between the object 30 and the storage tool 10 in the stacking direction Lx1. That is, the buffer tool 20 is arranged to reduce a gap SP1 generated between the object 30 and the storage tool 10. The buffer tool 20 includes the base 21, the first fold F1, and the space adjusting portion 22. The base 21 of the buffer tool 20 faces the object 30 in the stacking direction Lx1 from the bottom 11 toward the lid 14. That is, the base 21 is arranged to face the object 30. The first fold F1 of the buffer tool 20 is provided to bend the buffer tool 20 between the space adjusting portion 22 and the base 21. The space adjusting portion 22 of the buffer tool 20 is connected to the base at the first fold F1.

The space adjusting portion 22 includes the adjusting region 23, the plurality of second folds F2, and the contact region 24 that is connected to the adjusting region 23 at one of the plurality of second folds F2 of the buffer tool 20. The adjusting region 23 of the buffer tool 20 extends in the stacking direction Lx1 in the storage tool 10. That is, the adjusting region 23 is arranged to extend in the stacking direction Lx1. The plurality of second folds F2 of the buffer tool 20 are distributed in the first direction Ax1. The plurality of second folds F2 are provided to bend the space adjusting portion 22 at each of the plurality of second folds F2, one of the plurality of second folds F2 defining a boundary between the contact region 24 and the adjusting region 23. The base 21, the adjusting region 23, and the contact region 24 are aligned in order.

Figure 5:
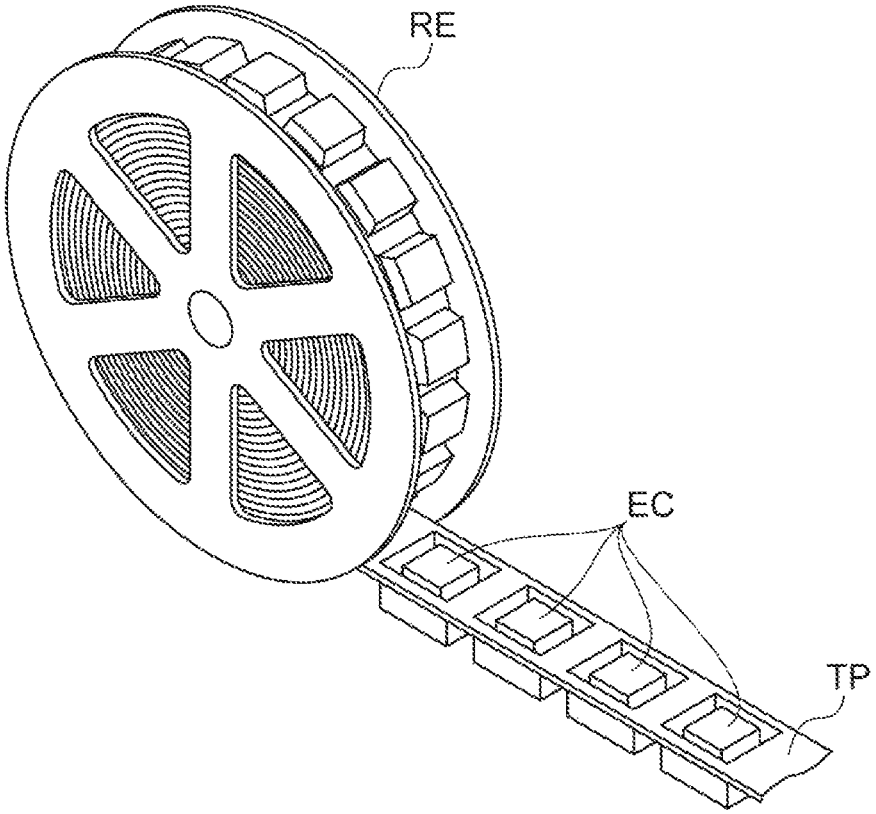
FIG. 5 is a perspective view illustrating a reel.

The object 30 includes a plurality of components 32. As illustrated in FIG. 5, the component 32 includes, for example, a reel RE around which a tape TP that stores electronic components EC is wound, or a tray that stores electronic components EC. The reel RE is stored in, for example, a packaging bag 31. The packaging bag 31 includes, for example, an aluminum or a plastic bag. The packaging bag 31 includes, for example, a first opening 31*a* and a second opening 31*b* at both ends of the packaging bag 31. For example, the first opening 31*a* and the second opening 31*b* are closed in a state where the reel RE is stored in the packaging bag 31. When the reel RE is stored in the packaging bag 31, gas may intrude into the packaging bag 31, so that the gas exists in the packaging bag 31. FIG. 5 is a perspective view illustrating the reel RE.

The object 30 forms an aggregate of a plurality of components 32. The object 30 as an aggregate is formed of, for example, three components 32. The object 30 may form an aggregate of two or four components 32.

The plurality of components 32 have, for example, heights H32 that are approximately equal to each other. When each of the components 32 has the height H32, all of the first interval W1, the second interval W2*a*, the second interval W2*b*, and the second interval W2*c* formed by the folds are approximately equal to the height H32 of each of the components 32. When the storage tool 10 has a height H10 from the bottom 11 to the lid 14 in the stacking direction Lx1, the maximum number of the components 32 storable in the storage tool 10 is a value obtained by dividing the height H10 of the storage tool 10 by the height H32 of the component 32. The stacking direction Lx1 is defined by, for example, a direction where the one or more components 32 are stacked on the bottom 11. The stacking direction Lx1 coincides with, for example, the direction where the one or more components 32 are stacked on the bottom 11. In the following description, the maximum number of the components 32 storable in the storage tool 10 is assumed to be "n."

When the number of the components 32 stored in the storage tool 10 is "n," in the storage tool 10, the gap SP1 to be filled is not generated between the object 30 and the storage tool 10. When the number of the components 32 stored in the storage tool 10 is "n−1," the gap SP1 corresponding to the height H32 of one component 32 is generated between the upper surface 30*a* of the object 30 and the lid 14 in the stacking direction Lx1 in the storage tool 10. When the number of the components 32 stored in the storage tool 10 is "n−1," the gap SP1 corresponding to the height H32 of one component 32 is filled with the buffer tool 20.

When the number of the components 32 stored in the storage tool 10 is "n-2," the gap SP1 corresponding to a height of two components 32, namely, a value that is two times the height H32 is generated between the upper surface 30*a* of the object 30 and the lid 14 in the stacking direction Lx1 in the storage tool 10. When the number of the components 32 stored in the storage tool 10 is "n-2," the buffer tool 20 fills the gap SP1 corresponding to the height of two components 32, namely, the value that is two times the height H32. Hereinafter, the gap SP1 to be filled with the buffer tool 20 will be described in specific examples.

FIG. 4A illustrates an example where the number of the components 32 stored is three in the storage tool 10 capable of storing up to five components 32. The buffer tool 20 fills the gap SP1 corresponding to a height of two components 32, namely, a value that is two times the height H32. In the buffer tool 20, the space adjusting portion 22 is bent between the contact region 24 and the adjusting region 23 at the second fold F2*b* of the four second folds F2. The second fold F2*b* defines the boundary between the contact region 24 and the adjusting region 23. A space between the first fold F1 and the second fold F2*b* corresponds to the height of two components 32, namely, the value that is two times the height H32. The contact region 24 includes two second folds F2 that are included only in the contact region 24. The two second folds F2 are the second fold F2*c* and the second fold F2*d*.

Next, an example where the number of the components 32 stored is four in the storage tool 10 capable of storing up to five components 32 will be described. In this example, the buffer tool 20 fills the gap SP1 corresponding to the height H32 of one component 32. In the buffer tool 20, the space adjusting portion 22 is bent between the contact region 24 and the adjusting region 23 at the second fold F2*a* of the four second folds F2. The second fold F2*a* defines the boundary between the contact region 24 and the adjusting region 23. A space between the first fold F1 and the second fold F2*a* corresponds to the height of one component 32. The contact region 24 includes three second folds F2 that are included only in the contact region 24. The three second folds F2 consist of the second fold F2*b*, the second fold F2*c*, and the second fold F2*d*.

Next, an example where the number of the components 32 stored is two in the storage tool 10 capable of storing up to five components 32 will be described. In this example, the buffer tool 20 fills the gap SP1 of a size corresponding to a height of three components 32, namely, a value that is three times the height H32. In the buffer tool 20, the space adjusting portion 22 is bent between the contact region 24 and the adjusting region 23 at the second fold F2*c* of the four second folds F2. The second fold F2*c* defines the boundary between the contact region 24 and the adjusting region 23. A space between the first fold F1 and the second fold F2*c* corresponds to the height of three components 32. The contact region 24 includes one second fold F2 that is included only in the contact region 24. The one second fold F2 is the second fold F2*d*.

Next, an example where the number of the components 32 stored is one in the storage tool 10 capable of storing up to five components 32 will be described. In this example, the buffer tool 20 fills the gap SP1 of a size corresponding to a height of four components 32, namely, a value that is four times the height H32. In the buffer tool 20, the space adjusting portion 22 is bent between the contact region 24 and the adjusting region 23 at the second fold F2*d* of the four second folds F2. The second fold F2*d* defines the boundary between the contact region 24 and the adjusting region 23. A space between the first fold F1 and the second fold F2*d* corresponds to the height of four components 32. The contact region 24 does not include the second fold F2 that is included only in the contact region 24.

As apparent from the description using the example where the maximum number of the components 32 storable in the storage tool 10 is five, when the number of the plurality of second folds F2 is four, the buffer tool 20 fills the gap SP1 generated between the object 30 and the storage tool 10 in all the cases where the number of the components 32 stored in the storage tool 10 is one to four. When the maximum number of the components 32 storable in the storage tool 10 is "n," the buffer tool 20, which includes the second folds F2 having "n−1" folds, fills the gap SP1 generated between the object 30 and the storage tool 10 in all the cases where the number of the components 32 stored in the storage tool 10 is one to "n−1."

In the example where the number of the components 32 stored is five in the storage tool 10 capable of storing up to five components 32, the buffer tool 20 is only bent between the base 21 and the space adjusting portion 22 at the first fold F1. In the space adjusting portion 22, the boundary between the contact region 24 and the adjusting region 23 is not required to be defined. The contact region 24 includes all the four second folds F2 that are included in the space adjusting portion 22. The buffer tool 20 having the four second folds may be stored in the storage tool 10.

In the present embodiment, for example, the object 30 and the buffer tool 20 are stored in order in the storage tool 10, and then the first flap 13*a* and the second flap 13*b* are closed and the lid 14 is further closed to complete the package 1 that stores the object 30 and the buffer tool 20. When the object 30 and the buffer tool 20 are stored in the storage tool 10, first, the object 30 may be stored on the bottom 11 of the storage tool 10 and thereafter, the buffer tool 20 may be stacked thereon. First, the buffer tool 20 may be stored on the bottom 11 of the storage tool 10 and thereafter, the object 30 may be stacked thereon. That is, the one or more components 32 are, for example, stacked on the buffer tool 20. When the buffer tool 20 is first stored on the bottom 11 of the storage tool 10, the through-hole TH1 provided in the buffer tool 20 is in contact with the bottom 11 of the storage tool 10. The stacking direction Lx1 is defined by, for example, a direction where the one or more components 32 are stacked on the buffer tool 20.

In an example of a cross-sectional configuration of the package illustrated in FIG. 4A, the object 30 includes an aggregate of three components 32, and the buffer tool 20 is stacked on the aggregate of three components 32. The buffer tool 20 fills the gap SP1 corresponding to the height of two components 32. The space adjusting portion 22 is bent between the contact region 24 and the adjusting region 23 at the second fold F2*b* of the four second folds F2. The second fold F2*b* defines the boundary between the contact region 24 and the adjusting region 23. The contact region 24 includes two second folds F2 that are included only in the contact region. The contact surface 24*a* of the contact region 24 has a width corresponding to a space from the end portion 22*e* of the space adjusting portion 22 to the second fold F2*b*.

As illustrated in FIG. 4A, when the object 30 and the buffer tool 20 are stacked on the bottom 11 to be stored in the storage tool 10, the object 30 has a first height H1 in the stacking direction Lx1. The first height H1 corresponds to a height of three components 32, namely, a value that is three times the height H32. The buffer tool 20 is bent between the base 21 and the space adjusting portion 22 at the first fold F1. The space adjusting portion 22 is bent between the contact region 24 and the adjusting region 23 at the second fold F2*b* of the four second folds F2 such that the adjusting region 23 has a second height H2 in the stacking direction Lx1. The second height H2 corresponds to a space from the first fold F1 to the second fold F2*b*, namely, the sum of the first interval W1 and the second interval W2*a*. In the present embodiment, the sum of the first height H1 and the second height H2 is approximately equal to the height H10 of the storage tool 10 from the bottom 11 to the lid 14 in the stacking direction Lx1.

The object 30 includes the component 32 stored in the packaging bag 31 made of an aluminum foil, and gas exists in the packaging bag 31. In the example of FIG. 4A, the object 30 is stored in the storage tool 10 and the storage tool 10 that stores the object 30 is transported under normal pressure. FIG. 4A illustrates the package 1 in which the object 30 and the buffer tool 20 are stored under normal pressure.

In an example of a cross-sectional configuration of the package illustrated in FIG. 4B, the package 1 under reduced pressure is illustrated. The package 1 may be transported by airplane, and during air transport, the package 1 is placed in an environment under reduced pressure where ambient atmospheric pressure is reduced, so that the shape of the packaging bag 31 is changed. The packaging bag 31 is made of an aluminum foil. The packaging bag 31 has, for example, a shape where the first opening 31*a* and the second opening 31*b* at both ends thereof are closed, namely, a shape where both ends thereof are sealed. Under reduced pressure, the packaging bag 31 has a shape where the packaging bag 31 expands from the end portion toward the center portion.

Effects obtained by the above-described embodiment will be described. In the present embodiment, in the package 1, the buffer tool 20 includes the base 21 and the space adjusting portion 22. When the space adjusting portion 22 includes the plurality of second folds F2, one second fold F2 that defines the boundary between the contact region 24 and the adjusting region 23 is selected from the plurality of second folds F2. When the object 30 and the buffer tool 20 are stored in the storage tool 10 in the stacking direction Lx1, the width of the adjusting region 23 of the buffer tool 20 is adjustable to be changed due to the size of the gap SP1 generated between the object 30 and the storage tool 10 in the stacking direction Lx1. The adjusting region 23 extends in the stacking direction Lx1 to reduce the gap SP1 generated between the object 30 and the storage tool 10 in the stacking direction Lx1. The contact region 24 comes into contact with the object 30 to reduce a movement of the object 30 in the storage tool 10, with the adjusting region 23. There is provided the package 1 in which the buffer tool 20 is adjustable to sufficiently reduce the gap SP1 generated between the object 30 and the storage tool 10.

In the present embodiment, the sum of the first height H1 and the second height H2 is approximately equal to the height from the bottom 11 to the lid 14 in the stacking direction Lx1, namely, the height H10 of the storage tool 10. In this case, the gap SP1 generated between the object 30 and the storage tool 10 is more sufficiently reduced. The first fold F1 is provided on, for example, the first surface 20*a*. In this case, the buffer tool 20 is easily bent inward of the first surface 20*a* between the base 21 and the space adjusting portion 22 at the first fold F1. The plurality of second folds F2 is provided on the first surface 20*a*. In this case, the space adjusting portion 22 is easily bent inward of the first surface 20*a* between the contact region 24 and the adjusting region 23 at one of the second folds F2.

In the present embodiment, the base 21 facing the object 30 includes the through-hole TH1. In this case, the object 30 stored can be seen through the through-hole TH1 when the object 30 and the buffer tool 20 are stored in order in the storage tool 10. The contact region 24 comes into contact with the object 30 at the contact surface 24*a* of the contact region 24. A movement of the object 30 in the storage tool 10 may occur during transport of the package 1. When the contact region 24 includes a contact surface 24*a*, the buffer tool 20 reduces the movement of the object 30.

In the present embodiment, the minimum value of the third interval W3 of the contact region 24 is larger than the maximum value of either of the first interval W1 and the second interval W2. In this case, the contact region 24 having a wide width comes into contact with the object 30 when the object 30 and the buffer tool 20 are stored in order in the storage tool 10. The buffer tool 20 further reduces the movement of the object 30, which may occur during transport of the package 1.

In the present embodiment, the buffer tool 20 is made of a corrugated cardboard. In this case, the buffer tool 20 is lightweight and is easy to produce. At least one of the first fold and the second fold intersects the grain direction Bx1 of the corrugated cardboard. In this case, the buffer tool 20 has high mechanical strength in a state where the buffer tool 20 is bent at the fold.

In the present embodiment, the shape of the buffer tool 20 is changed due to the size of the gap SP1 generated between the object 30 and the storage tool 10 in the stacking direction Lx1. When a package 1 containing a packaging bag 31 in which gas exists is transported by airplane, and the volume of the packaging bag 31 increases due to a decrease in atmospheric pressure and the shape of the package bag 31 changes, the buffer tool 20 absorbs the change in the shape of the packaging bag 31. For example, even when the shape of the packaging bag 31 is changed so as to expand from the end portion toward the center portion, the contact region 24 continues to contact the upper surface 30*a* of the object 30 since the angle formed by the contact region 24 and the adjusting region 23 is decreased in the space adjusting portion 22. The buffer tool 20 absorbs a change in shape of the object 30, or an increase in volume of the object 30.

In the present embodiment, the object 30 is an aggregate of "n" components 32 having heights approximately equal to each other. In this case, the buffer tool 20 having "n−1" second folds F2 distributed at approximately equal intervals is prepared when the object 30 is an aggregate of "n" components having heights approximately equal to each other. In the buffer tool 20, one second fold F2 that defines the boundary between the contact region 24 and the adjusting region 23 is easily selected by counting the number of components 32. The object 30 is an aggregate of reels RE around each of which a tape that stores electronic components EC is wound. In this case, the buffer tool 20 sufficiently reduces the gap SP1 generated between the object 30 and the storage tool 10.

In another aspect of the present embodiment, the buffer tool 20 includes the base 21 and the space adjusting portion 22, of which the space adjusting portion 22 includes a plurality of the second folds F2. One second fold F2 that defines the boundary between the contact region 24 and the adjusting region 23 is selected from the plurality of second folds F2. When the object 30 and the buffer tool 20 are stored in the storage tool 10 in the stacking direction Lx1, the width of the adjusting region 23 of the buffer tool 20 is changeable due to the size of the gap SP1 generated between the object 30 and the storage tool 10 in the stacking direction Lx1. The adjusting region 23 extends in the stacking direction Lx1 to reduce the gap SP1 generated between the object 30 and the storage tool 10 in the stacking direction Lx1. The contact region 24 comes into contact with the object 30 to reduce a movement of the object 30 in the storage tool 10, with the adjusting region 23. There is provided the buffer tool 20 that is adjustable to sufficiently reduce the gap SP1 generated between the object 30 and the storage tool 10.

Although the embodiment of the present invention has been described above, the present invention is not necessarily limited to the embodiment, and the embodiment can be variously changed without departing from the scope of the invention.

What is claimed is:

1. A package comprising:

a storage portion configured to store an object; and a buffer portion configured to (1) be received in the storage portion and (2) reduce a gap between the object and an internal surface of the storage portion in a stacking direction of the buffer portion and the object when the buffer portion and the object are in the storage portion and the storage portion is in a closed state; wherein the storage portion includes a bottom and a lid facing the bottom, the buffer portion includes a base configured to face the object in the storage portion, a first fold adjacent an edge of the base, and a space adjusting portion connected to the base by the first fold, the first fold is configured such that the buffer portion is bendable between the base and the space adjusting portion at the first fold, the space adjusting portion includes a plurality of second folds distributed in a first direction intersecting the first fold, the plurality of second folds being spaced in the first direction between the first fold and a free end edge of the space adjusting portion opposite the first fold, the plurality of second folds are configured such that the space adjusting portion can be variably divided into an adjusting region, to adjust a height of the buffer portion in the stacking direction, and a contact region by bending the space adjusting portion at each of the plurality of second folds, the each of the plurality of second folds defining a boundary between the contact region and the adjusting region, the adjusting region has a first edge at the first fold and a variable second edge at the each of the plurality of second folds, the contact region includes the free end edge of the space adjusting portion, the storage portion and the buffer portion are configured such that a lowermost surface of the buffer portion in the stacking direction and the bottom define a space to store the object when the buffer portion and the object are in the storage portion and the storage portion is in the closed state, and the buffer portion is configured such that, when (1) the object and the buffer portion are stacked on the bottom to be stored in the storage portion, (2) the buffer portion is bent between the base and the space adjusting portion at the first fold, and (3) the each of the plurality of second folds defines the boundary between the contact region and the adjusting region, a sum of a height of the adjusting region and a height of the object in the stacking direction is approximately equal to a height from the bottom to the lid in the stacking direction.

2. The package according to claim 1, wherein the buffer portion is configured such that the base includes a lower surface facing the object when the buffer portion and the object are stored in the storage portion, the buffer portion includes a first surface including the lower surface, and the first fold is on the first surface.

3. The package according to claim 2, wherein the plurality of second folds are on the first surface.

4. The package according to claim 2, wherein the base further includes an upper surface opposite to the lower surface and a through-hole penetrating through the base from the upper surface to the lower surface.

5. The package according to claim 1, wherein the space adjusting portion includes an end portion defining an end of the buffer portion in the first direction, the buffer portion includes a first interval between the first fold and a second fold of the plurality of second folds adjacent to the first fold in the first direction, a second interval between the plurality of second folds adjacent to each other in the first direction, and a third interval between a second fold of the plurality of second folds that is farthest away from the first fold among the plurality of second folds and the free end edge of the space adjusting portion in the first direction, and a minimum value of the third interval is larger than a maximum value of either of the first interval and the second interval.

6. The package according to claim 1, wherein the buffer portion is made of a corrugated cardboard, and at least one of the first fold and the plurality of second folds intersects a grain direction of the corrugated cardboard.

7. The package according to claim 1, wherein the buffer portion is configured such that the space adjusting portion is to be bent at only one of the plurality of second folds when the buffer portion and the object are stored in the storage portion.

8. The package according to claim 1, wherein the contact region is not directly coupled to the base.

9. The package according to claim 1, wherein the buffer portion is configured such that lengths of the adjusting region and the contact region in the first direction are variable depending at which one of the plurality of second folds the space adjusting portion is bent.

10. A package comprising:

a storage portion configured to store an object; and a buffer portion configured to (1) be received in the storage portion and (2) reduce a gap between the object and an internal surface of the storage portion in a stacking direction of the buffer portion and the object when the buffer portion and the object are in the storage portion and the storage portion is in a closed state; wherein the storage portion includes a bottom and a lid facing the bottom, the buffer portion includes a base configured to face the object in the storage portion, a first fold adjacent an edge of the base, and a space adjusting portion connected to the base by the first fold, the first fold is configured such that the buffer portion is bendable between the base and the space adjusting portion at the first fold, the space adjusting portion includes a plurality of second folds distributed in a first direction intersecting the first fold, the plurality of second folds being spaced in the first direction between the first fold and a free end edge of the space adjusting portion opposite the first fold, the plurality of second folds are configured such that the space adjusting portion can be variably divided into an adjusting region, to adjust a height of the buffer portion in the stacking direction, and a contact region by bending the space adjusting portion at each of the plurality of second folds, the each of the plurality of second folds defining a boundary between the contact region and the adjusting region, the adjusting region has a first edge at the first fold and a variable second edge at the each of the plurality of second folds, the contact region includes the free end edge of the space adjusting portion, the storage portion and the buffer portion are configured such that a lowermost surface of the buffer portion in the stacking direction and the bottom define a space to store the object when the buffer portion and the object are in the storage portion and the storage portion is in the closed state, the buffer portion is configured such that the lowermost surface faces the object when the buffer portion and the object are stored in the storage portion, the buffer portion includes a first surface including the lowermost surface, and the first fold is on the first surface, and the base includes an upper surface opposite to the lowermost surface and a through-hole penetrating through the base from the upper surface to the lowermost surface.

11. The package according to claim 10, wherein the plurality of second folds are on the first surface.

12. The package according to claim 10, wherein the space adjusting portion includes an end portion defining an end of the buffer portion in the first direction, the buffer portion includes a first interval between the first fold and a second fold of the plurality of second folds adjacent to the first fold in the first direction, a second interval between the plurality of second folds adjacent to each other in the first direction, and a third interval between a second fold of the plurality of second folds that is farthest away from the first fold among the plurality of second folds and the free end edge of the space adjusting portion in the first direction, and a minimum value of the third interval is larger than a maximum value of either of the first interval and the second interval.

13. The package according to claim 10, wherein the buffer portion is made of a corrugated cardboard, and at least one of the first fold and the plurality of second folds intersects a grain direction of the corrugated cardboard.

14. The package according to claim 10, wherein the buffer portion is configured such that the space adjusting portion is to be bent at only one of the plurality of second folds when the buffer portion and the object are stored in the storage portion.

15. The package according to claim 10, wherein the contact region is not directly coupled to the base.

16. The package according to claim 10, wherein the buffer portion is configured such that lengths of the adjusting region and the contact region in the first direction are variable depending at which one of the plurality of second folds the space adjusting portion is bent.

* * * * *